United States Patent [19]

Nishiyama et al.

[11] Patent Number: 4,912,368

[45] Date of Patent: Mar. 27, 1990

[54] COLD CATHODE DISCHARGE TUBE WITH SERIES CONNECTED CAPACITOR

[75] Inventors: Kazuo Nishiyama; Tadao Sugai, both of Hadano; Keiichi Ichikawa, Hiratsuka, all of Japan

[73] Assignee: Stanley Electric Co., Ltd., Tokyo, Japan

[21] Appl. No.: 248,945

[22] Filed: Sep. 20, 1988

[30] Foreign Application Priority Data

Sep. 25, 1987 [JP] Japan ..... 62-241350

[51] Int. Cl.[4] ..... H01J 7/44; H01J 17/34

[52] U.S. Cl. ..... 315/58; 315/71

[58] Field of Search ..... 315/58, 71; 313/235, 313/288, 289, 326, 331, 332

[56] References Cited

U.S. PATENT DOCUMENTS 4,270,071 5/1981 Morton ..... 315/58 X

*Primary Examiner*—David Mis

*Attorney, Agent, or Firm*—Frishauf, Holtz, Goodman & Woodward

[57] ABSTRACT

A cold cathode discharge tube operating at a high frequency includes a capacitor mounted on at least one electrode terminal of the tube. The capacitor is a feedthrough capacitor, and serving as a ballast capacitor is electrically connected in series with the tube. The distributed capacitance of the power source leads can be neglected in operation because of the presence of the feedthrough ballast capacitor mounted on the electrode terminal of the tube.

12 Claims, 1 Drawing Sheet

COLD CATHODE DISCHARGE TUBE WITH SERIES CONNECTED CAPACITOR

BACKGROUND OF THE INVENTION

The present invention relates to a cold cathode discharge tube, and more particularly to a cold cathode discharge tube capable of operating at a frequency higher than conventional.

A conventional cold cathode discharge tube has a structure as shown in FIG. 2. The cold cathode tube 20 has electrodes 20*a* whose terminals 20*b* extend to the outside of a glass envelope 20*c*. The cold cathode tube 20 starts operating when a high frequency power outputted from an inverter 21 is applied across the terminals 20*b* via leads 22. Distributed capacitance of the leads 22 cannot be neglected because a high frequency output power is used. Therefore, a ballast capacitor 21*a* has heretofore been added to the inverter 21 for compensating for the distributed capacitance of the leads 22.

If the output frequency of the inverter 21 is high, the inverter and its peripheral system can be made small in size. Thus, it is preferable to use as high a frequency as possible. However, with the above conventional cold cathode discharge tube, the higher the frequency becomes, the greater becomes the influence of the distributed capacitance of the leads 22, so that the ballast capacitor 21*a* becomes unable to compensate for the phase delay, thus resulting in insufficient starting voltage and failure of operating of the tube. As above, the conventional cold cathode discharge tube has a limit of allowable frequency, and of miniaturization of the inverter and its peripheral system.

OBJECTS OF THE INVENTION

It is an object of the present invention to solve the above prior art problems and to provide a cold cathode discharge tube which can operate at a frequency higher than conventional and wherein the inverter and its peripheral system can be made small in size.

SUMMARY OF THE INVENTION

According to the present invention, a cold cathode discharge tube which operates at a high frequency comprises a capacitor mounted on at least one electrode terminal of the tube, the capacitor being electrically connected in series with the tube. Therefore, the distributed capacitance of the electrode leads can be compensated by the serially connected capacitor.

DETAILED DESCRIPTION

Figure 1:
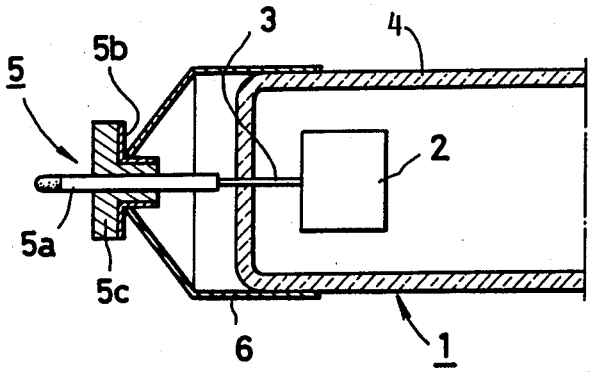
FIG. 1 is a cross sectional view showing the main part of an embodiment of a cold cathode discharge tube according to the present invention.

A preferred embodiment of the present invention will now be described with reference to FIG. 1.

A cold cathode discharge tube generally designated by reference numeral 1 is provided with a capacitor at an electrode terminal 3 connected to an electrode 2 of the tube 1 and which is extended to the outside of a glass tube or envelope 4. The capacitor is connected in series with the electrode 2.

As particularly shown in FIG. 1, the presently preferred embodiment uses as such a capacitor a feedthrough capacitor 5 which is widely used as a noise eliminator. A cap 6 in the form of a tube with a conical end portion is mounted on one end portion of the glass tube 4. The cap 6 is made of a conductive material such as a metal and is attached to the wall of the glass tube 4 by suitable means such as an adhesive agent. The feedthrough capacitor 5 is mounted at a hole formed in the conical end portion of the cap 6, and is comprised of a feedthrough electrode 5*a* connected to the electrode terminal 3, a peripheral electrode 5*b* connected to the cap 6, and a dielectric member 5*c* through which the feedthrough electrode 5*a* passes.

Figure 2:
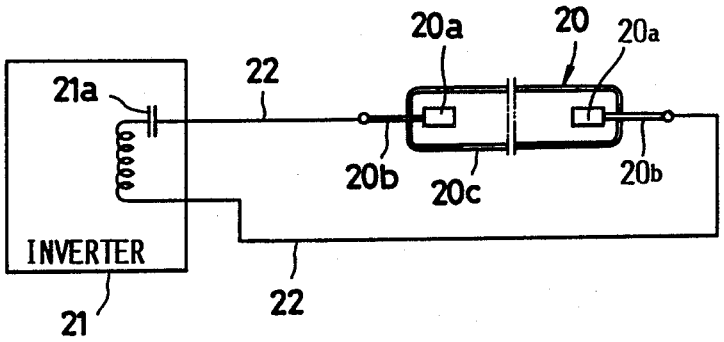
FIG.2 (PRIOR ART)
FIG. 2 shows a conventional cold cathode discharge tube connected to a high frequency power source.

With the cold cathode discharge tube 1 constructed as above, a high frequency power from an inverter (such as the one described with reference to FIG. 2) is coupled to the cap 6 and is fed to the electrode 2 via the dielectric member 5*c* and the electrode lead 3. The feedthrough capacitor 5 connected in series with the electrode 2 serves as a ballast capacitor.

More particularly, since the feedthrough capacitor 5 serving as a ballast capacitor is connected to the electrode 2 very near to the electrode 2, the distributed capacitance can be compensated to the extent that any practical problem in operation does not occur irrespective of the frequency of the power source, thus solving the problem of phase delay. It becomes possible therefore to apply a sufficiently high frequency starting voltage to the electrode 2.

In FIG. 1, although one electrode 2 of the cold cathode discharge tube 1 has been provided with the feedthrough capacitor 5, the other electrode may be used as conventional or with the feedthrough capacitor structure 5 shown in FIG. 1. If the other electrode with the feedthrough capacitor does not require a ballast capacitor, then the lead from the high frequency power source is directly connected to the feedthrough electrodes 5*a* of the feedthrough capacitor 5 instead of via the cap 6, to thus disable the ballast capacitor function.

As described above, according to the present invention, a capacitor serving as a ballast capacitor is connected in series with the electrode of the cold cathode discharge tube very near to the electrode. Therefore, the influence of the distributed capacitance of the power source leads and the phase delay can be eliminated so that the starting voltage lowering can be neglected. Accordingly, a frequency higher than conventional can be used for the power source, to thereby allow a compact inverter and its peripheral system.

While the invention has been disclosed in connection with a preferred embodiment thereof, it will be recognized by those skilled in the art that various modifications of the invention are possible within the spirit and scope of the invention as defined by the following claims.

What is claimed is:

1. In a cold cathode discharge tube operable at a high frequency, comprising: an elongated tubular envelope having a pair of spaced apart electrodes therein; and a pair of electrode terminals respectively electrically coupled to said electrodes and extending to the outside of said envelope;

the improvement comprising:

a capacitor mounted on at least one of said electrode terminals near its respective electrode, said capacitor being electrically connected in series with said electrodes of said tube.

2. The cold cathode discharge tube of claim 1, wherein said capacitor comprises a feedthrough capacitor.

3. The cold cathode discharge tube of claim 2, wherein electrodes extend to the outside of said envelope at respective ends of said envelope, and wherein capacitor is mounted to at least one end of said tubular envelope.

4. The cold cathode discharge tube of claim 3, wherein said capacitor comprises:

a conductive member mounted to said at least one end of said tubular envelope, and having a conductive portion spaced from and surrounding the electrode at said at least one end; and a dielectric material surrounding said electrode at said at least one end of said envelope, and being interposed between said electrode and its associated conductive member;

whereby electrical high frequency power is selectively applicable directly to said electrode or to its associated conductive member.

5. The cold cathode discharge tube of claim 4, wherein said conductive member comprises a metal end cap connected to an end of said tubular envelope, said metal end cap having a substitute conical end portion the smallest diameter portion of which surrounds said at least one electrode.

6. The cold cathode discharge tube of claim 5, wherein said capacitor further comprises a peripheral electrode coupled between said dielectric material and said smallest diameter portion of said conical end portion and being electrically connected to said smallest diameter portion of said conical end portion.

7. The cold cathode discharge tube of claim 1, wherein electrodes extend to the outside of said envelope at respective ends of said envelope, and wherein capacitor is mounted to at least one end of said tubular envelope.

8. The cold cathode discharge tube of claim 5, wherein said capacitor comprises:

a conductive member mounted to said at least one end of said envelope, and having a conductive portion spaced from and surrounding the electrode at said at least one end; and a dielectric material surrounding said electrode at said at least one end of said envelope, and being interposed between said electrode and its associated conductive member;

whereby electrical high frequency power is selectively applicable directly to said electrode or to its associated conductive member.

9. The cold cathode discharge tube of claim 8, wherein said conductive member comprises a metal end cap connected to an end of said tubular envelope, said metal end cap having a substitute conical end portion the smallest diameter portion of which surrounds said at least one electrode.

10. The cold cathode discharge tube of claim 9, wherein said capacitor further comprises a peripheral electrode coupled between said dielectric material and said smallest diameter portion of said conical end portion and being electrically connected to said smallest diameter portion of said conical end portion.

11. The cold cathode discharge tube of claim 1, wherein said tubular envelope is a glass envelope.

12. The cold cathode discharge tube of claim 2, wherein said tubular envelope is a glass envelope.

* * * * *